United States Patent [19]

Cairns et al.

[11] 4,226,493

[45] Oct. 7, 1980

[54] TERMINAL BLOCK WITH FUSE GUARDS AND IDENTIFICATION SURFACE

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,473

[22] Filed: Mar. 1, 1979

[51] Int. Cl.[3] ..... H01R 13/631

[52] U.S. Cl. ..... 339/66 M; 339/147 R; 339/217 S; 339/258 F

[58] Field of Search ..... 339/147 R, 147 P, 186 R, 339/186 M, 184 R, 184 M, 198 G, 198 K, 198 S, 217 S, 139, 154 RA, 113 R, 113 B, 126 R, 66 R, 66 M, 219 F, 258 F, 262 F; 337/198; 361/426, 430, 431, 357, 360, 347, 348

[56] References Cited

U.S. PATENT DOCUMENTS

| | | | |
|---|---|---|---|
| 2,831,087 | 4/1958 | Sundt | 337/198 |
| 2,851,671 | 9/1958 | Luce | 339/150 R |
| 2,955,178 | 10/1960 | Lander et al. | 337/188 |
| 3,060,293 | 10/1962 | Lapidus | 337/4 |
| 3,253,252 | 5/1966 | Piperato et al. | 339/198 P |
| 3,341,745 | 9/1967 | Munro | 361/349 |
| 3,634,812 | 1/1972 | Genova | 339/262 F X |
| 3,775,723 | 11/1973 | Mamrick et al. | 337/245 |
| 3,775,724 | 11/1973 | Mamrick et al. | 337/245 |
| 3,851,224 | 11/1974 | Ege | 361/349 |
| 3,898,951 | 11/1974 | Michael et al. | 116/239 |
| 3,909,767 | 9/1975 | Williamson et al. | 337/264 |
| 4,097,109 | 6/1978 | Cross | 339/258 F X |

*Primary Examiner*—Howard N. Goldberg
*Assistant Examiner*—Eugene F. Desmond
*Attorney, Agent, or Firm*—Peter Abolins; Clifford L. Sadler

[57] ABSTRACT

This specification discloses an automobile terminal block for receiving fuses and electrical connections to various electrical components of the automobile. The terminal block has a passage for receiving a fuse holder which is mounted within the terminal block. A blade contact from the fuse is received by the fuse holder. The upper end of two adjacent passages receive a portion of the body of the fuse. At both ends of the fuse, extending upward from the top of the passages is a generally semi-circular fuse guard. The fuse guards shield the fuse from forces that might result in accidential or undesirable removal of the fuse from the terminal block. The fuse guards are spaced from one another and extend only around an end portion of the fuse so that a central portion of the fuse can be easily grasped by the fingers for easy removal from the terminal block. The terminal block also includes an identification surface extending laterally outward from the base of the fuse guard so that information identifying the fuse adjacent the surface can be inscribed thereon. It is particularly advantageous that there can be this combination of a fuse guard and an identification surface. Further, the fuse guard and identification surface can be mounted on a removable connector body which can be removed to provide a space adapted for receiving a circuit breaker, which is larger than a fuse. The fuse receiving passages can also include an entry control ledge for guiding and securing a fuse.

2 Claims, 6 Drawing Figures

TERMINAL BLOCK WITH FUSE GUARDS AND IDENTIFICATION SURFACE

BACKGROUND OF THE INVENTION (1) Field of the Invention

This invention relates to electrical connectors and, more particularly, to a terminal block which removably secures connectors and fuses for automobiles.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous other electrical options which can be customer selected on automobiles.

Although it is desired that the fuses be readily removable and reinsertable both during assembly and repair, it is also desirable to avoid unintentional or accidental removal of the fuses. At the same time, it is desirable to provide a surface adjacent the fuse for displaying information identifying the fuse. This greatly assists in insuring that the correct value (i.e., current carrying capacity) of the fuse is used and facilitates locating the fuse for an inoperative portion of the electrical system. Up to now, the requirements of fuse protection and identification of a miniature fuse as described in U.S. Pat. No. 3,909,767 assigned to Littlefuse Inc. have presented conflicting requirements which could not simultaneously be met at a commercially attractive price.

For example, in U.S. Pat. No. 4,097,109, there is shown a terminal block which has a flat portion adjacent each fuse which could be used for identification of the fuse. However, the fuse extends above this surface without any protection. Thus, although identification of each fuse may be accomplished relatively easily, the fuse is left exposed to being accidentally dislodged.

It is also desirable that a fuse terminal block be as versatile as possible so that it can be used in a variety of applications thus spreading the fixed cost over a larger number of units. In particular, there are some applications where a fuse may be desired, such as an electric power option drawing relatively little current, and applications where a circuit breaker is desired such as an electric power option which has a relatively heavy transient current demand. It would be desirable to have the capability of choosing either a fuse or a circuit breaker without the cost penalty of providing for accomodating the maximum number of circuit breakers and the maximum number of fuses in every terminal block. These are some of the problems this invention overcomes.

SUMMARY OF THE INVENTION

This invention recognizes that support means can extend above the top surface of a passage in a terminal block for an automotive electrical system thus providing protection against accidental removal of a fuse. The passage in the terminal block receives the fuse and the passage includes a fuse holder for receiving a blade contact of the fuse. The support means only partially surrounds the fuse so that there is exposed a portion of the fuse to facilitate intentional removal of the fuse from the passage. An identification surface extends generally perpendicular to the direction of extension of the support means. The identification surface extends generally lateral away from the top opening of the passage thereby providing a surface for displaying information about the fuse to be placed in the passage. Further, the support means can be mounted on a removable connector body to provide for the capability of using a larger size circuit breaker instead of a fuse. That is, when the connector body is removed from the terminal block there is created a sufficiently large cavity or socket to receive the larger circuit breaker.

DETAILED DESCRIPTION OF THE INVENTION

Figure 1:
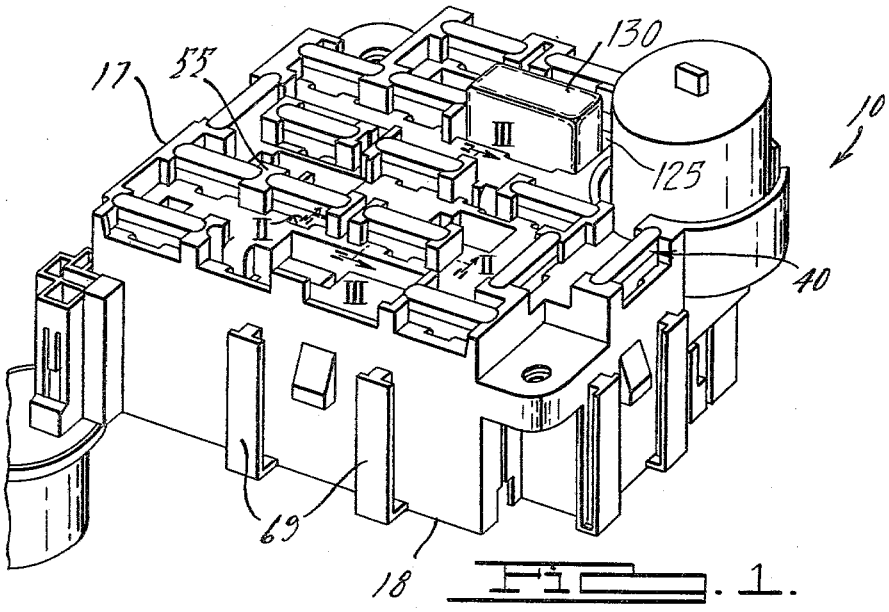
FIG. 1 is a perspective view of a terminal block in accordance with an embodiment of this invention.
Figure 2:
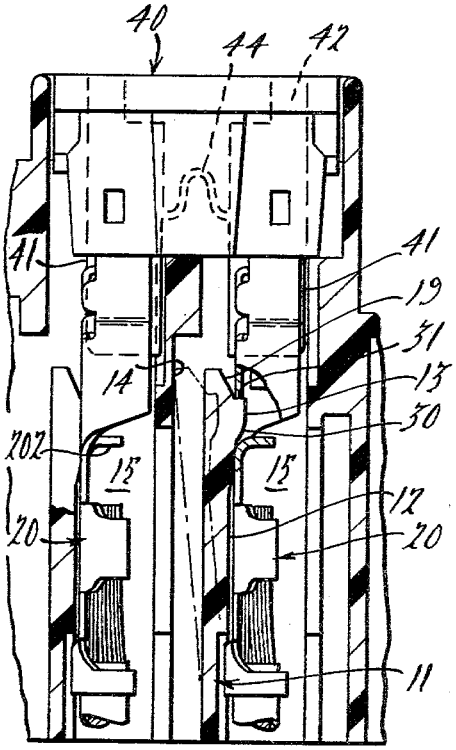
FIG. 2 is a partial section view taken along line II—II of FIG. 1.
Figure 3:
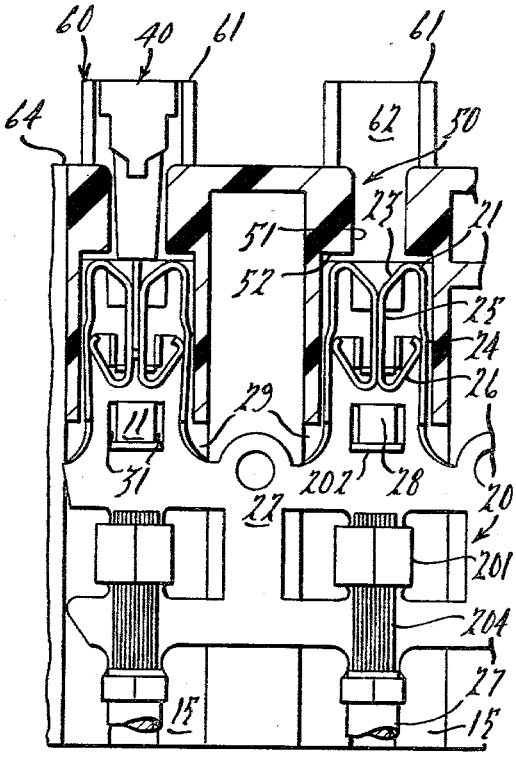
FIG. 3 is a partial section view taken along line III—III of FIG. 1 including a view of the fuse guard and identification surface.

Referring to FIG. 1, a terminal block 10 has the general shape of a rectangular solid with a plurality of passages 15 extending therethrough between a front (or top) surface 17 and a rear (or bottom) surface 18. At least some of passages 15 from top surface 17 of terminal block 10 are designed to receive a fuse 40 having a pair of spaced blade contacts 41. Fuse 40 is advantageously a miniature plug-in fuse similar to that described in U.S. Pat. No. 3,909,767 issued Sept. 30, 1975 and assigned to Littlefuse, Inc. At least some of passages 15 are accessible from bottom surface 18 of terminal block 10 and are adapted to receive a fuse holder 20 as shown in FIGS. 2 and 3. Further, various accessory connections can be made from the bottom and the top of terminal block 10 to a bus bar 22 of fuse holder 20 or, in some cases, directly to blade contacts 41 of fuse 40. Additional description of the above fuse terminal block assembly is included in the following copending applications, the disclosures of which are incorporated by reference herein: Title of I—Terminal Block With Electrical Connection Means With Connector Location Wall and Locking Finger, Ser. No. 16,469; Title of II—Fuse Holder With Entry Control; Ser. No. 16,468 Title of VI—Fuse Holder With Insertion Ramp—Ser. No. 16,579.

This invention is directed toward a fuse guard 60 extending from an indentification surface 64 of terminal block 10. Fuse guard 60 includes a pair of spaced, generally semicircular end portions 61 having curved interior surfaces 62 which abut the ends of fuse 40 and are shaped to conform to the ends of fuse 40. The top surface 17 of fuse guard 60 extends substantially to the height of the top of fuse 40 when fuse 40 is inserted into terminal block 10. The exterior surface of fuse guard 60 is made of three perpendicular planes which facilitate close placement of fuse guard 60 and therefore dense packing of fuses 40.

An identification surface 64 extends laterally from the base of fuse guard 60. That is, identification surface 64 extends out from the top of passage 15 and is coplanar with top surface 17. The identification surface 64 for a particular fuse is positioned adjacent a line connecting the two portions of fuse guard 60 for that fuse.

The use of identification surface 64 is particularly advantageous because the top of fuse guard 60 does not provide sufficient area to display adequate information about an adjacent fuse 40. Identification surface 64 can have applied thereto offset symbols indicating the size and function of the fuse adjacent to the particular identification surface 64.

Referring to FIG. 1, a circuit breaker 130 is positioned in a socket or cavity 125 in terminal block 10. Typically, circuit breaker 130 is substantially larger than a fuse 40. Nevertheless, there are occasions when it is desired to replace circuit breaker 130 by a fuse 40 and have the fuse blade contacts 41 connected to the same electrical points that were connected to the blade contacts of circuit breaker 130. To this end, a connector body 120 is used to adapt cavity 125 to receive a fuse 40. Connector body 120 includes a fuse guard 60 and an identification surface 64 so that a fuse replacing circuit breaker 130 can be properly protected and identified.

Figure 4:
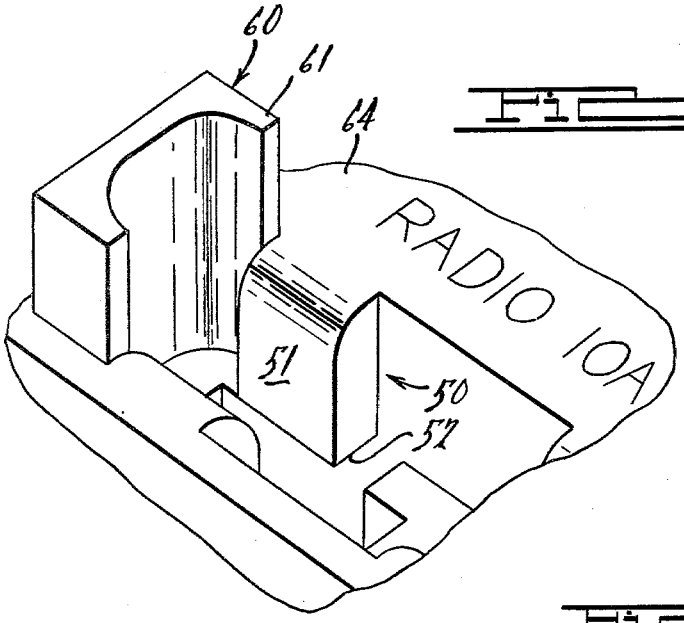
FIG. 4 is a perspective view of a passage opening including a fuse guard and an adjacent identification surface in accordance with an embodiment of this invention.
Figure 5:
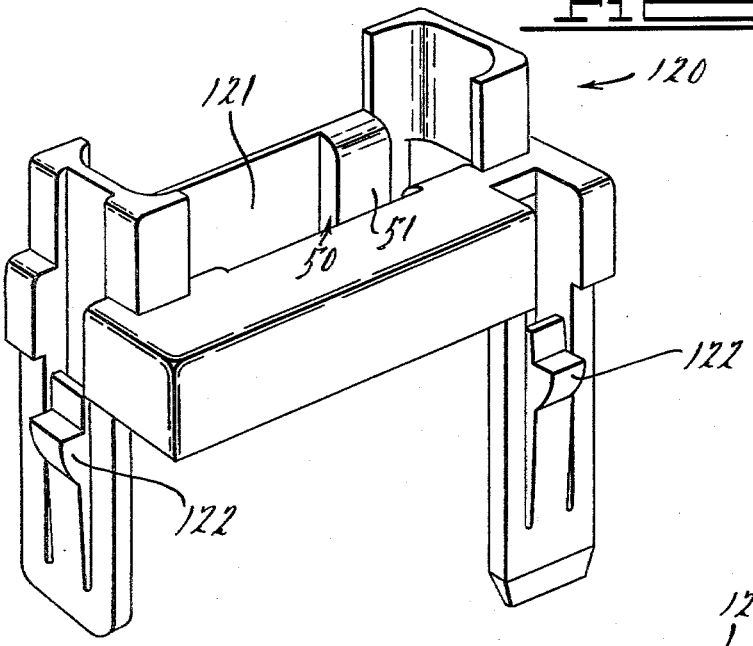
FIG. 5 is a perspective view of a connector body for adapting a circuit breaker opening to a fuse opening, and vice versa, and including a fuse guard and identification surface in accordance with an emdodiment of this invention.
Figure 6:
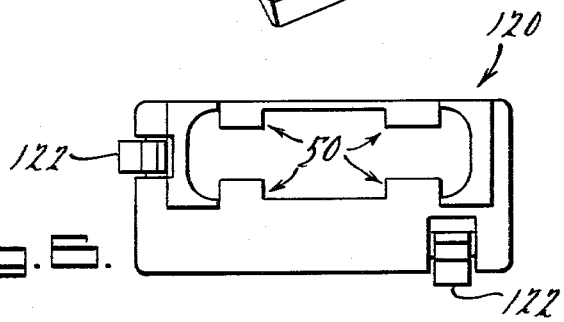
FIG. 6 is a top plan view of the connector body of FIG. 5.

Referring to FIGS. 3, 4 and 5, an entry control ledge 50 extends from each side of passage 15 in a direction perpendicular to the plane defined by the abutment of prongs 21 with each other. Accordingly, outside portions 24 of each of prongs 21 are guarded or covered from above by entry control ledge 50. Entry control ledge 50 extends sufficiently along the aforementioned plane in a direction lateral to the insertion of fuse 40 so as to shield a substantial portion of spring clip 23.

With the presence of entry control ledge 50 even a careless insertion of fuse 40 insures that blade contacts 41 cannot enter the region between outside portion 24 of prongs 21 and the wall of passage 15. In particular, as shown in FIG. 3, the control ledge 50 insures that blade contact 41 enters passage 15 at a position only between intermediate portions 25 of prongs 21. As a result, both the speed of assembly and replacement of fuses 40 can be increased while providing for substantially fool proof system insuring that the blade contacts 41 are positioned between the wall of passages 15 and intermediate portion 25. Such a fault can be particularly troubling because it is difficult to locate or may be intermittent in nature. Further, inspection of the fuse itself would indicate that the fusing link is operating properly.

Entry control ledge 50 can extend upward so that there is an insertion guide face 51 facing inward within passage 15. Fuse 40 includes a pair of opposing indentations 45 at each of the ends of fuse 40 which are laterally spaced from one another a distance to the spacing of insertion guide face 51. The uppermost portion of insertion guide face 51 is curved so that a blade contact 41 striking is guided towards the area between opposing insertion guide faces 51. When fuse 40 is inserted into terminal block 10 insertion guide faces 51 are snug against indentation 45 of fuse 40 so that there is a securing influence by face 51 of terminal block 10.

Connector body 120 has a main portion shaped as a rectangular solid with a generally rectangular central opening 121 therethrough. The inwardly facing surface of central opening 121 has raised ramps 210 for guiding the blade contacts of the fuse and preventing excessive movement of the body of the fuse when positioned in terminal block 10. Extending downward from the main portion of connector body 120 are a pair of locking fingers 122 including protrusions 123. Cavity 125 includes recesses (not shown) for releasably mating to locking fingers 122. As a result, two passages 15 associated with cavity 125 can be used in conjunction with a circuit breaker when connector body 120 is removed from cavity 125 and can be used in conjunction with a fuse 40 when connector body is positioned in cavity 125.

Terminal block 10 is molded of a plastic material. A typical spacing between the closest edges of opposing ledges is about 0.13 inches. A typical lateral spacing between adjacent ledges is about 0.3 inches. A typical width of ledge 50 extending outward from the wall of the passage toward the other ledge is about 0.075 inches; and a typical height is about 0.25 inches. Fuse guard 60 has a height of 0.23 inch above identification surface 64 and said end portions 61 are spaced at a distance of 0.78 inches from each other.

Various modifications and variations will no doubt occur to those skilled in the various arts to which this invention pertains. For example, the particular shape of the identification surface or the exterior surface of the fuse guard may be varied from that described herein. These and all other variations which basically rely on the teachings through which this disclosure has advanced the art are properly considered within the scope of this invention.

We claim:

1. A fuse terminal block assembly for an automotive electrical system, said fuse terminal block assembly having a terminal block with a passage for receiving a blade contact of a fuse, said passage including a fuse holder for contacting the blade contact of a fuse;

a support means extending above the top surface of said passage so as to partially surround a fuse inserted into said passage thus providing protection against accidental removal of the fuse from said passage and yet exposing a portion of said fuse to facilitate intentional removal of the fuse from said passage;

an identification surface extending generally perpendicular to the direction of extension of said support means, said identification surface extending generally laterally away from the top opening of said passage for providing a surface for displaying information about the fuse to be placed in said passage; and a cavity in said terminal block and a connector body insertable in said cavity, said connector body being adapted to receive a fuse, said cavity being adapted for receiving a circuit breaker thus increasing the versatility of said terminal block, said connector body having an opening aligned with said passage for receiving a fuse, said connector body including said support means and further including connection means for coupling said connector body to the remainder of said terminal block, said connector body being removable from said terminal so that there is provided an opening sufficiently large for the insertion of a circuit breaker with contacts reaching the same contact points in said fuse holder as a fuse which is used in conjunction with said connector body, said connection means including a pair of spaced fingers engaging a portion of said terminal block adjacent said passage and said terminal block including a latch means for receiving said fingers thereby releasably securing said connector body as a part of said terminal block.

2. A fuse terminal block assembly for an automotive electrical system, said fuse terminal block assembly having a terminal block with a passage for receiving a blade contact of a fuse, said passage including a fuse holder for contacting the blade contact of a fuse;

a support means extending above the top surface of said passage so as to partially surround a fuse inserted into said passage thus providing protection against accidental removal of the fuse from said passage and yet exposing a portion of said fuse to facilitate intentional removal of the fuse from said passage;

an identification surface extending generally perpendicular to the direction of extension of said support means, said identification surface extending generally laterally away from the top opening of said passage for providing a surface for displaying information about the fuse to be placed in said passage;

said passage has an entry control means for guiding the blade contacts of the fuse toward the fuse holder;

said fuse holder includes a spring clip with two mirror image prongs folded back on themselves so that the blade contact of the fuse can be held resiliently between the two prongs;

said entry control means extending from each side of said passage over at least a portion of each of said two prongs so that the blade contacts of the fuse are guided between the two prongs thereby insuring a good electrical connection and are prevented from entering the region between the passage wall and one of the prongs; and said entry control means includes a ledge of sufficient height, in the direction of blade contact insertion, so that it can provide an insertion guide for the body of a fuse inserted into said terminal block and apply a securing influence on the body of the fuse when the fuse is positioned in the terminal block, the top surface of said entry control means having a downwardly sloping surface toward said fuse holder so that a blade contact of a fuse striking said top surface is guided to a seating position between said two prongs.

* * * * *